US009116465B2

(12) United States Patent
Kim et al.

(10) Patent No.: US 9,116,465 B2
(45) Date of Patent: Aug. 25, 2015

(54) TONER BUFFER UNIT OF AN ELECTROPHOTOGRAPHIC IMAGE FORMING APPARATUS

(71) Applicant: Samsung Electronics Co., Ltd., Suwon-si (KR)

(72) Inventors: Jin-hong Kim, Gwangmyeong-si (KR); Jong-hwa Park, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/204,105

(22) Filed: Mar. 11, 2014

(65) Prior Publication Data

US 2015/0098716 A1 Apr. 9, 2015

(30) Foreign Application Priority Data

Oct. 7, 2013 (KR) ..... 10-2013-0119459

(51) Int. Cl.
*G03G 15/08* (2006.01)

(52) U.S. Cl.
CPC ..... *G03G 15/0831* (2013.01); *G03G 15/0858* (2013.01)

(58) Field of Classification Search
CPC ..... G03G 15/0831
USPC ..... 399/27, 258
See application file for complete search history.

(56) References Cited

U.S. PATENT DOCUMENTS

| | | | | |
|---|---|---|---|---|
| 6,041,196 | A | 3/2000 | Nakagawa et al. | |
| 6,795,660 | B2 * | 9/2004 | Yugeta et al. | 399/27 |
| 2011/0206389 | A1 * | 8/2011 | Naruse | 399/27 |
| 2011/0206391 | A1 | 8/2011 | Naruse | |
| 2012/0148312 | A1 * | 6/2012 | Takahashi | 399/258 |

FOREIGN PATENT DOCUMENTS

| | | |
|---|---|---|
| JP | 2-73276 | 3/1990 |
| JP | 11-174812 | 7/1999 |
| JP | 2013-037314 | 2/2013 |

OTHER PUBLICATIONS

Extended European Search Report dated Mar. 6, 2015 in European Patent Application No. 14159423.4.

* cited by examiner

*Primary Examiner* — Sandra Brase
(74) *Attorney, Agent, or Firm* — Staas & Halsey LLP

(57) ABSTRACT

Provided is an electrophotographic image forming apparatus including: a toner buffer unit arranged between a toner cartridge and a developing unit to receive toner from the toner cartridge and supply the toner to the developing unit; and a toner level detection unit. The toner buffer unit includes a first buffer unit connected to the toner cartridge. A first conveyance member including a rotation shaft and a conveyance wing provided in the rotation shaft and transporting the toner in a radial direction is provided in the first buffer unit. The toner buffer unit includes an elevation plate provided in the first buffer unit and elevated according to a toner level, and a sensor unit detecting a location of the elevation of the elevation plate. The elevation plate is located to be spaced apart from the conveyance wing in an axial direction of the rotation shaft.

16 Claims, 10 Drawing Sheets

TONER BUFFER UNIT OF AN ELECTROPHOTOGRAPHIC IMAGE FORMING APPARATUS

CROSS-REFERENCE TO RELATED APPLICATIONS

This application claims the priority benefit of Korean Patent Application No. 10-2013-0119459, filed on Oct. 7, 2013, in the Korean Intellectual Property Office, the disclosure of which is incorporated herein in its entirety by reference.

BACKGROUND

1. Field

One or more embodiments relate to an electrophotographic image forming apparatus that prints an image by supplying toner to an electrostatic latent image formed in a photoreceptor to develop the image, and by transferring and fusing the developed image on a recording medium.

2. Description of the Related Art

In electrophotographic image forming apparatuses, an electrostatic latent image is formed on a surface of a photosensitive body by scanning light that is modulated according to image information onto the photosensitive body, the electrostatic latent image is developed into a visible toner image by supplying toner to the electrostatic latent image, and the developed image is transferred to a recording medium and fused thereto so that an image is printed on the recording medium.

A developing unit developing the electrostatic latent image may receive the toner from a toner cartridge. The toner cartridge is replaced when the toner is consumed all. Whether the toner is consumed all or not may be detected by providing a toner level detection sensor to detect the remaining amount of toner in the toner cartridge. In addition, a buffer unit receiving toner from the toner cartridge and providing the toner to the developing unit may be positioned between the developing unit and the toner cartridge. In this case, the toner level detection sensor may detect the remaining amount of toner in the buffer unit.

SUMMARY

In an aspect of one or more embodiments, there is provided an electrophotographic image forming apparatus capable of reliably detecting the remaining amount of toner in a buffer unit.

In an aspect of one or more embodiments, there is provided an electrophotographic image forming apparatus capable of increasing a capacity of a buffer unit.

In an aspect of one or more embodiments, there is provided an electrophotographic image forming apparatus which includes: a developing unit including a photoreceptor; a toner cartridge; a toner buffer unit, which receives toner from the toner cartridge and which supplies the toner to the developing unit, the toner buffer unit including a first buffer unit connected to the toner cartridge, and the first buffer unit including a first conveyance member which includes a rotation shaft and a conveyance wing arranged in the rotation shaft to transport the toner in a radial direction; and a toner level detection unit which detects a remaining amount of toner in the first buffer unit, which includes an elevation plate arranged in the first buffer unit and configured to elevate according to a toner level, and which includes a sensor unit which detects an elevation location of the elevation plate, wherein the toner buffer unit is positioned between the toner cartridge and the developer unit, and wherein the elevation plate is located to be spaced apart from the conveyance wing in an axial direction of the rotation shaft.

The first buffer unit may include a conveyance region where the conveyance wing is positioned and a detection region where the elevation plate is positioned, wherein a transportation member transporting the toner to the conveyance region may be provided in the detection region.

The transportation member may be formed integrally with the rotation shaft.

The transportation member may include a tilting transportation plate configured to tilt with respect to the rotation shaft.

An eccentric cam contacting the elevation plate and periodically elevating the elevation plate by rotation of the rotation shaft.

The eccentric cam may be configured to tilt with respect to the rotation shaft so as to serve also as the transportation member.

The toner level detection unit may further include: a support shaft which is supported by a side wall of the first buffer unit, and which is connected to the elevation plate so as to be rotated by an elevation operation of the elevation plate; and a detection plate which extends toward an outer portion of the first buffer unit from the support shaft, wherein the sensor unit may detect the detection plate.

The elevation plate may include a first portion which extends from the support shaft and a second portion located in an end portion of the first portion and laid on a toner surface.

At least one penetration slot may be formed in the first portion.

A tilting portion tilting downwards may be formed at an edge of the first portion in the axial direction of the rotation shaft.

In the second portion, a penetration unit penetrated through an upper surface thereof to a bottom surface thereof may be formed in the second portion, and an area of the penetration unit may be smaller towards the bottom surface from the upper surface.

The toner buffer unit may further include a second buffer unit which connects the first buffer unit and the developing unit, the first conveyance member may convey the toner to the second buffer unit, and a second conveyance member which conveys the toner to the developing unit may be provided in the second buffer unit.

In an aspect of one or more embodiments, there is provided an electrophotographic image forming apparatus which includes: a developing unit including a photoreceptor; a toner cartridge; and a toner buffer unit including a first buffer unit that is arranged between the toner cartridge and the developing unit, receives toner from the toner cartridge and supplies the toner to the developing unit, the toner buffer unit comprising a first buffer unit connected to the toner cartridge, and a second buffer unit that is connected to the first buffer unit and the developing unit, wherein: the toner cartridge and the developing unit are arranged in a first direction perpendicular to an axial direction of the photoreceptor; the toner cartridge is located above the developing unit; the first buffer unit and the second buffer unit are arranged in a second direction that is the axial direction of the photoreceptor, and are located next to the developing unit in the first direction and below the toner cartridge; the second buffer unit is located above the developing unit; and the first buffer unit further extends below the second buffer unit.

A first conveyance member which pumps up the toner and conveys the toner to the second buffer unit may be positioned in the first buffer unit, and a second conveyance member which conveys the toner in the first direction and supplies the toner to the developing unit may be positioned in the second buffer unit.

A rotation shaft of the first conveyance member may be parallel to a rotation shaft of the second conveyance member, and the rotation shaft of the first conveyance member may be located below the rotation shaft of the second conveyance member.

The electrophotographic image forming apparatus may further include a toner level detection unit which detects a toner level in the first buffer unit.

The electrophotographic image forming apparatus, wherein the first conveyance member includes a rotation shaft and a conveyance wing arranged in the rotation shaft and transporting the toner in a radial direction; the first buffer unit may include a conveyance region where the conveyance wing is positioned and a detection region that is positioned in a side of the conveyance region; and the toner level detection unit may include an elevation plate positioned in the detection region and elevated according to the toner level, and a sensing unit which detects the position of the elevation plate.

An eccentric cam contacting the elevation plate and periodically elevating the elevation plate may be prepared in the detection region.

The eccentric cam may be formed in the rotation shaft of the first conveyance member.

The eccentric cam may be configured to tilt with respect to the rotation shaft of the first conveyance member to convey the toner in the detection region to the conveyance region.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
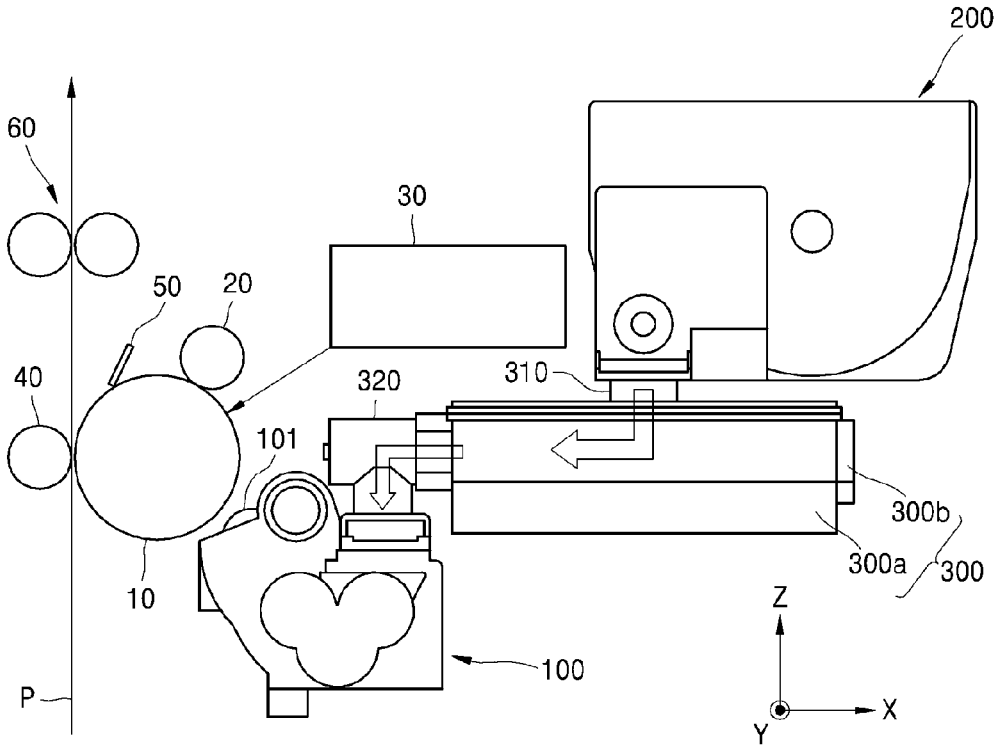
FIG. 1 is a block diagram briefly illustrating an electrophotographic image forming apparatus according to an embodiment.

Reference will now be made in detail to embodiments, examples of which are illustrated in the accompanying drawings, wherein like reference numerals refer to the like elements throughout. In this regard, embodiments may have different forms and should not be construed as being limited to the descriptions set forth herein. Accordingly, embodiments are merely described below, by referring to the figures, to explain aspects of the present disclosure.

Figure 2:
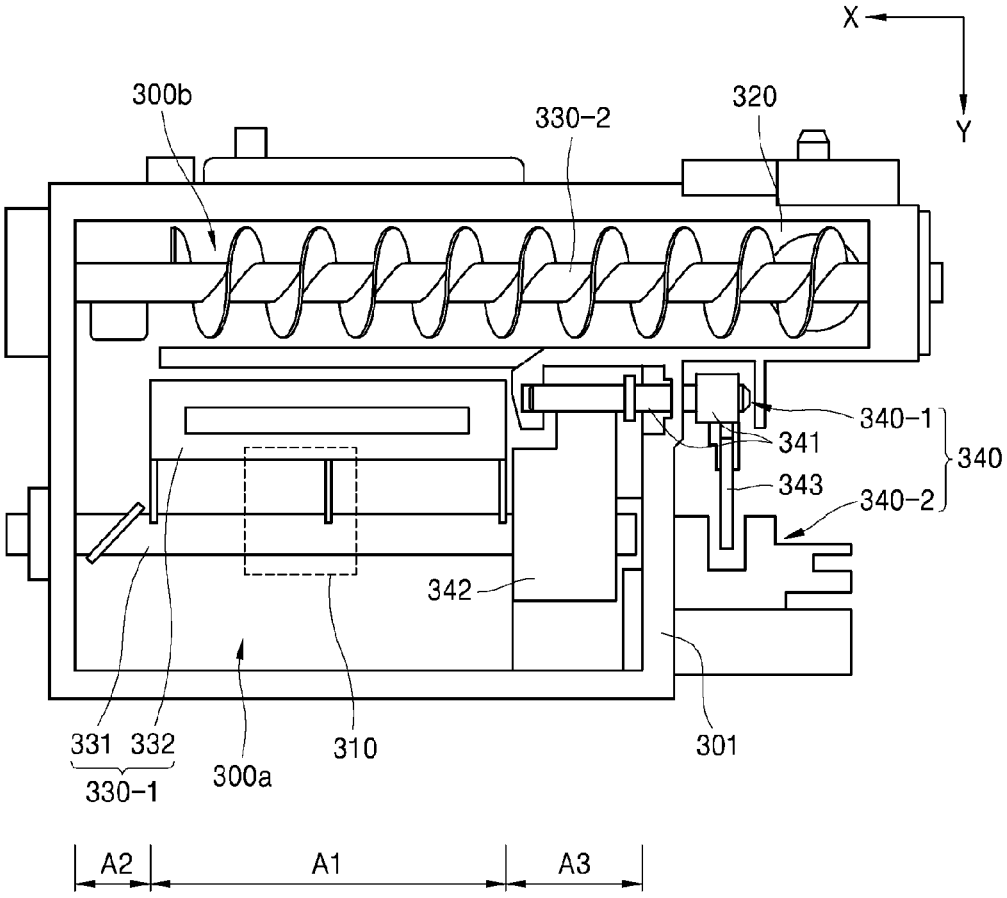
FIG. 2 is a lateral cross-sectional view of a toner buffer unit according to an embodiment.
Figure 3:
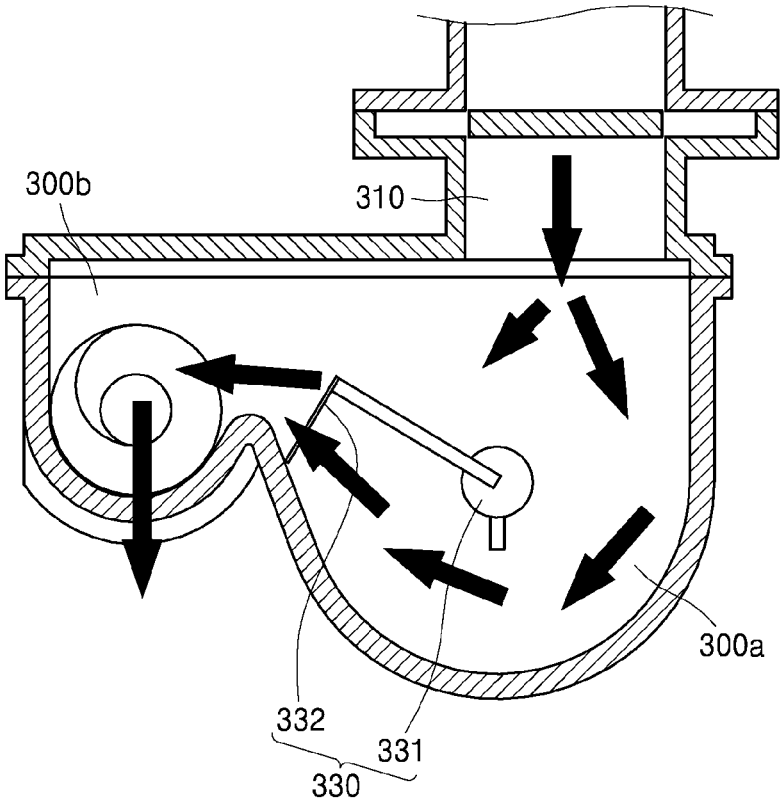
FIG. 3 is a vertical cross-sectional view of a toner buffer unit according to an embodiment.

FIG. 1 is a block diagram briefly illustrating an electrophotographic image forming apparatus according to an embodiment. FIG. 2 is a lateral cross-sectional view of a toner buffer unit 300 according to an embodiment. FIG. 3 is a vertical cross-sectional view of the toner buffer unit 300 according to an embodiment. The image forming apparatus according to an embodiment is a monochrome image forming apparatus. The toner may be, for example, black color.

Referring to FIG. 1, a photosensitive drum 10 is an example of a photoreceptor, on which an electrostatic latent image is formed, and includes a photosensitive layer having a photoconductivity formed on an outer circumference of a cylindrical metal pipe. Instead of using the photosensitive drum 10, a photosensitive belt, in which a photosensitive layer is formed on an outer surface of a circulating belt, may be used.

The charging roller 20 is an example of a charger that charges a surface of the photosensitive drum 10 to a uniform charging potential. The charging roller 20 rotates while contacting the photosensitive drum 10, and a charging bias voltage is applied to the charging roller 20. A corona charger (not shown) that charges the surface of the photosensitive drum 1 by causing a corona discharge may be used, instead of the charging roller 20.

The exposing unit 30 scans light corresponding to image information onto the surface of the photosensitive drum 10 that is charged to form an electrostatic latent image. A laser scanning unit (LSU) that scans light irradiated from a laser diode onto the photosensitive drum 10 by deflecting the light in a main scanning direction by using a polygon mirror may be used as the exposing unit 30; however, embodiments are not limited thereto.

The developing unit 100 contains a developing agent. The developing unit 100 supplies a toner in the developing agent to the electrostatic latent image formed on the photosensitive drum 10 to form a visible toner image on the surface of the photosensitive drum 10.

The transfer roller 40 is an example of a transfer unit that transfers the toner image formed on the photosensitive drum 10 onto a printing medium. The transfer roller 40 faces the photosensitive drum 10 to form a transfer nip, and a transfer bias voltage is applied to the transfer roller 40. A transfer electric field is formed between the photosensitive drum 10 and the transfer roller 40 due to the transfer bias voltage. The toner image formed on the surface of the photosensitive drum 10 is transferred onto a recording medium P by the transfer electric field that is formed in a transfer nip. A coroner transfer unit using a corona discharge may be used instead of the transfer roller 40.

The toner remaining on the surface of the photosensitive drum 10 after the transfer is removed by a cleaning member 50. The cleaning member 50 may, for example, be a blade, an end portion of which contacts the surface of the photosensitive drum 10, or a roller or a brush that rotates while contacting the photosensitive drum 10.

The toner image transferred onto the recording medium P is attached to the recording medium P by an electrostatic force. A fusing unit 60 fuses the toner image on the recording medium P by applying heat and pressure onto the toner image.

The developing unit 100 supplies toner contained therein to an electrostatic latent image formed on the photoconductive drum 10 to develop the electrostatic latent image into a visible toner image. When a one-component development method is used, toner is contained in the developing unit 100, and when a two-component development method is used, toner and a carrier are contained in the developing unit 100. A development roller 101 is used to supply the toner in the developing unit 100 to the photoconductive drum 10. A development bias voltage may be applied to the development roller 101.

The one-component development method may be classified into a contact development method, wherein the development roller 101 and the photoconductive drum 10 are rotated while contacting each other, and a non-contact development method, wherein the development roller 101 and the photoconductive drum 10 are rotated by being spaced apart from each other by tens to hundreds of microns.

When a two-component development method is used, the development roller 101 is spaced apart from the photoconductive drum 10 by tens to hundreds of microns. Although not illustrated, the development roller 101 may have a structure wherein a magnetic roller is disposed in a hollow cylindrical sleeve. The toner is adhered to a surface of a magnetic carrier. The magnetic carrier is adhered to the surface of the development roller 101 to be transferred to the development region where the photoconductive drum 10 and the development roller 101 face each other. Only the toner is supplied to the photoconductive drum 10 according to the development bias voltage applied between the development roller 101 and the photoconductive drum 10, and thus the electrostatic latent image formed on the surface of the photoconductive drum 10 is developed into the visible toner image. The developing unit 100 may include a transport agitator (not shown) for mixing and stirring the toner and a carrier and transporting the mixture to the development roller 101. The transport agitator may be an auger, and a plurality of the transport agitators may be positioned (arranged) in the developing unit 100.

Toner contained in a toner cartridge 200 is supplied to the developing unit 100. When the toner contained in the toner cartridge 200 is all consumed, the toner cartridge 200 may be replaced by a new toner cartridge 200 or new toner may be charged in the toner cartridge 200. To this end, a toner level detection unit that detects the remaining amount of toner in the toner cartridge 200 is needed. When the toner level detection unit is provided in the toner cartridge 200, a printing operation is available only when the toner cartridge 200 is replaced after it is detected that the toner in the toner cartridge 200 is all consumed. Thus, until the toner consumption state is identified and a new toner cartridge is purchased, the printing operation may not be performed.

In order to resolve this inconveniency and to stably supply toner to the developing unit 100, a toner buffer unit 300 temporarily containing the toner is positioned between the toner cartridge 200 and the developing unit 100. The toner buffer unit 300 receives the toner from the toner cartridge 200, contains a predetermined amount of toner, and again transports the contained toner to the developing unit 100. The toner level detection unit is provided in the toner buffer unit 300. According to this configuration, even if the toner in the toner cartridge 200 is all consumed, since a predetermined amount of toner remains in the toner buffer unit 300, a printing operation is available until a new toner cartridge 200 is purchased.

Referring to FIG. 1, the developing unit 100 and the toner cartridge 200 are arranged in a width direction X, and each of the developing unit 100 and the toner cartridge 200 has a form extending in a depth direction Y perpendicular to the width direction X. The depth direction Y is an axial direction of the photosensitive drum 10. The toner cartridge 200 is located to be spaced apart from the developing unit 100 in the width direction X and a gravity direction Z. The toner cartridge 200 is located above the developing unit 100 in the gravity direction Z. The toner buffer unit 300 may be located between the developing unit 100 and the toner cartridge 200 in the gravity direction Z.

Referring to FIGS. 2 and 3, the toner buffer unit 300 extends in the width direction (a first direction) X perpendicular to the axial direction of the photosensitive drum 10 to connect the toner cartridge 200 and the developing unit 100. The toner buffer unit 300 includes a first buffer unit 300*a* connected to the toner cartridge 200 and a second buffer unit 300*b* connected to developing unit 100. The toner supplied from the toner cartridge 200 passes through the first buffer unit 300*a* and the second buffer unit 300*b*, and is supplied to the developing unit 100. The first buffer unit 300*a* and the second buffer unit 300*b* extend in the width direction X. The first buffer unit 300*a* and the second buffer unit 300*b* are arranged in the depth direction (a second direction) Y that is the axial direction of the photosensitive drum 10.

Referring to FIGS. 1 through 3, the first buffer unit 300*a* includes a toner inflow portion 310 into which a toner inflow is made from the toner cartridge 200, and the second buffer unit 300*b* includes a toner discharge portion 320 for supplying the toner to the developing unit 100. According to an embodiment, the toner inflow portion 310 extends upwards from an upper surface of the first buffer unit 300*a* to be connected to the toner cartridge 200, and the toner discharge portion 320 extends from a side portion of the second buffer unit 300*b* in the width direction X and again extends downwards to be connected to the developing unit 100. The toner inflow portion 310 is connected to a bottom portion of the toner cartridge 200, and the toner drops from the toner cartridge 200 to the first buffer unit 300*a* due to gravity. The toner discharge portion 320 is connected to an upper portion of the developing unit 100, and the toner drops from the second buffer unit 300*b* to the developing unit 100 due to gravity.

The more the amount of toner contained in the toner buffer unit 300 is, the more stable the printing operation is until the toner cartridge 200 is replaced by a new one after the toner contained in the toner cartridge 200 is consumed all. To this end, within the limitation of not increasing the overall size of the image forming apparatus, there is a need to increase the capacity of the first buffer unit 300*a* and the second buffer unit 300*b* as much as possible. The toner buffer unit 300 is located in overall next to the width direction of the developing unit 100 and below the toner cartridge 200. When the second buffer unit 300*b* has a form extending more downwards than an upper surface of the developing unit 100, an additional device to pump up the toner contained in the second buffer unit 300*b* upwards against the gravity direction Z is required so that the structure of the toner buffer unit 300 may be complicated and the components and manufacturing costs may be increased. According to the present embodiment, the toner discharge portion 320 is located above the developing unit 100, and, the second buffer unit 300*b* is located in overall above the developing unit 100 to make the toner supplied naturally to the developing unit 100 due to gravity. Since the extension of the second buffer unit 300*b* in the gravity direction Z is limited by the toner cartridge 200 and the developing unit 100, the second buffer unit 300*b* may extend in the width direction X. However, since the second buffer unit 300*b* should be located between the developing unit 100 and the toner cartridge 200 in the gravity direction Z so that an area of the second buffer unit 300*b* in the vertical direction is small, even if the second buffer unit 300*b* extends in the width direction X, the effect of increasing the capacity amount of toner is limited, compared to the first buffer unit 300*a*. Therefore, in order to increase the capacity amount of toner in the toner buffer unit 300, extension of the first buffer unit 300*a* is more advantageous. Although an upward extension is limited by the toner cartridge 200, a downward extension is not limited. Therefore, as illustrated in FIG. 2, the first buffer unit

300*a* is a form extending more downwards than the second buffer unit 300*b*, and, in overall, the capacity of the first buffer unit 300*a* is greater than the capacity of the second buffer unit 300*b*. In addition, the first buffer unit 300*a* may also extend in the width direction X.

As described above, since the first buffer unit 300*a* has a form extending more downwards than the second buffer unit 300*b*, the toner supplied from the toner cartridge 200 to be contained in the first buffer unit 300*a* should again be conveyed upwards against the gravity direction Z to the second buffer unit 300*b* and then supplied to the developing unit 100. To this end, a first conveyance member 330-1 conveying the toner to the second buffer unit 300*b* is positioned in the first buffer unit 300*a*.

Referring to FIGS. 2 and 3, the first conveyance member 330-1 includes a rotation shaft 331 extending in the width direction X and a conveyance wing 332 arranged (positioned) in the rotation shaft 331. The conveyance wing 332 may, for example, be a flexible elastic film attached to the rotation shaft 331 and having lengths in the width direction X and a radial direction (direction of a radius). The conveyance wing 332 conveys the toner in the radial direction. Accordingly, when the first conveyance member 330-1 rotates, the toner contained in the first buffer unit 300*a* is pumped up against the gravity direction Z by the conveyance wing 332 and conveyed to the second buffer unit 300*b*. A second conveyance member 330-2 conveying the toner to the toner discharge portion 320 may be positioned in the second buffer unit 300*b*. For example, the second conveyance member 330-2 may include an auger having a spiral wing formed on an outer circumference of the rotation shaft extending in the width direction X. The second conveyance member 330-2 having the auger form may extend to the toner discharge portion 320. Since the first buffer unit 300*a* has a form extending more downwards than the second buffer unit 300*b*, the center of the first conveyance member 330-1, that is, the location of the rotation shaft 331 is below the center of the second conveyance member 330-2. According to this configuration, the capacity amount of toner in the toner buffer unit 300 may increase.

The toner buffer unit 300 further includes a toner level detection unit 340. The toner level detection unit 340 detects the remaining amount of toner contained in the first buffer unit 300*a*. Referring to FIG. 2, the toner level detection unit 340 includes an elevation member 340-1 elevated according to a toner level of the first buffer unit 300*a*, and a sensing unit 340-2 detecting a location of the elevation member 340-1. The elevation member 340-1 includes, for example, a support shaft 341 supported by a side wall 301 of the first buffer unit 300*a* to be rotatable, and an elevation plate 342 extending from the support shaft 341 to an inner portion of the first buffer unit 300*a* to be elevated according to the toner level. The sensing unit 340-2 may directly or indirectly detect the elevation plate 342. The sensing unit 340-2 according to the present embodiment detects the remaining amount of toner in the first buffer unit 300*a* by detecting a detection plate 343 extending from the support shaft 341 to an outer portion of the first buffer unit 300*a*.

The elevation plate 342 is arranged (positioned) in a location in which an intervention with the conveyance wing 332 does not occur. For example, the elevation plate 342 is located to be spaced apart from the conveyance wing 332 in an axial direction of the rotation shaft 331. When the elevation plate 342 is elevated according to the toner level, the rotation shaft 341 rotates and the detection plate 343 is also elevated. The sensing unit 340-2 detects the remaining amount of toner in the first buffer unit 300*a* by detecting the location of the detection plate 343. However, the method in which the sensing unit 340-2 detects the location of the detection plate 343 is not limited thereto. For example, the sensing unit 340-2 detects the location of the detection plate 343 by using an optical sensor method that uses the changing of the light amount according to the location of the detection plate 343, or by using a magnetic sensor method that uses the changing of the magnetic field strength according to the location of the detection plate 343. The sensing unit 340-2 according to the present embodiment detects the location of the detection plate 343 by using the optical sensor method.

For the location of the elevation plate 342 to reflect the toner level, the elevation plate 342 should be afloat on a toner surface of the first buffer unit 300*a*. However, if the elevation plate 342 is buried by the toner because the toner accumulates on the elevation plate 342, the elevation plate 342 remains in the buried state because the elevation plate 342 does not have a buoyant force. In this state, the location of the elevation plate 342 may not reflect the toner level, and thus, the remaining amount of toner may not be accurately detected. To resolve the problem, there is a need to periodically elevate the elevation plate 342 so that the toner does not accumulate on the elevation plate 342.

Figure 4:
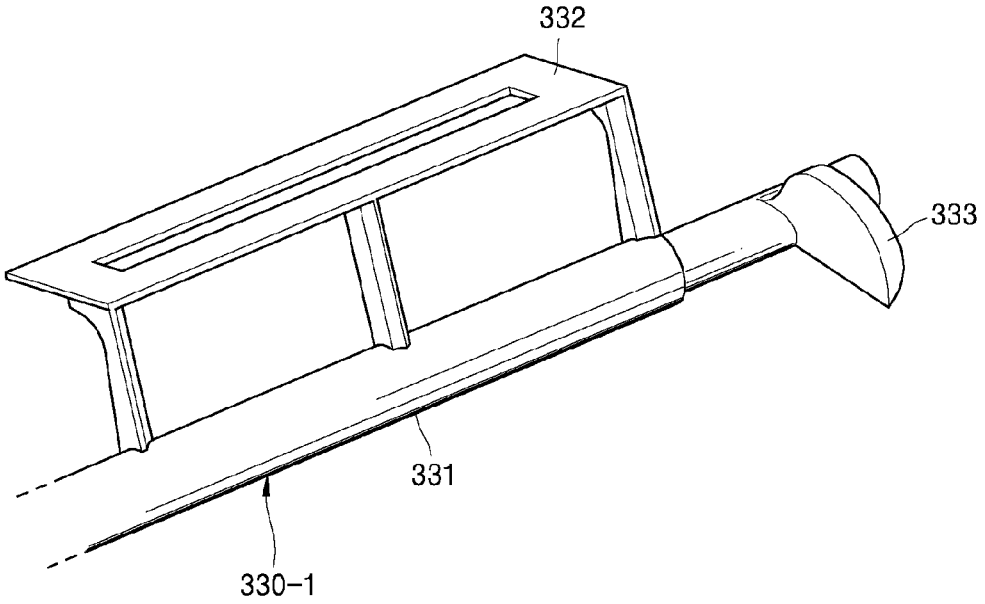
FIG. 4 is a perspective view of a first conveyance member where an eccentric cam is positioned (arranged), according to an embodiment.

FIG. 4 is a perspective view of the first conveyance member 330-1 where an eccentric cam 333 is positioned, according to an embodiment. Referring to FIG. 4, the eccentric cam 333 is arranged (positioned) in the rotation shaft 331 of the first conveyance member 330-1. For example, the eccentric cam 333 may be integrally formed with the rotation shaft 331. Alternatively, the eccentric cam 333 may be coupled to the rotation shaft 331. The eccentric cam 333 periodically elevates the elevation plate 342 while contacting the elevation plate 342 as the first conveyance member 330-1 rotates. The shape of the eccentric cam 333 is not limited to the example illustrated in FIG. 4, and it may include any types that may elevate the elevation plate 342 once, while the first conveyance member 330-1 rotates once. By the periodical elevation operation of the elevation plate 342, the toner accumulating on the elevation plate 342 may be brushed aside and the elevation plate 342 buried by the toner may be located on the toner surface. The eccentric cam 333 is arranged in an outer portion of the conveyance wing 332 of the rotation shaft 331 to contact the elevation plate 342. The number of components may be reduced by forming the eccentric cam 333 integrally with the rotation shaft 331 of the first conveyance member 330-1.

Figure 5A:
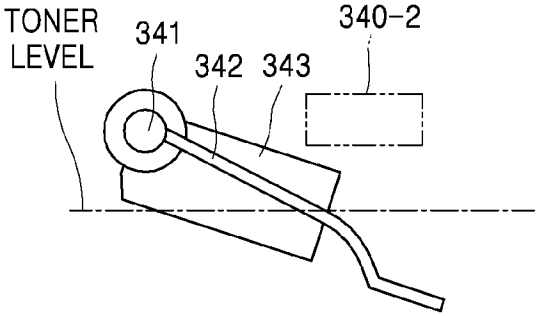
FIGS. 5A through 5C are views illustrating an operation of an eccentric cam.
Figure 5B:
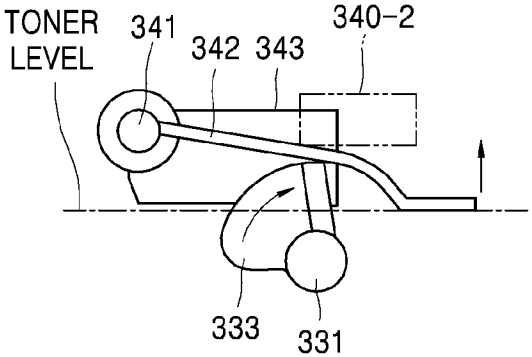
Figure 5C:
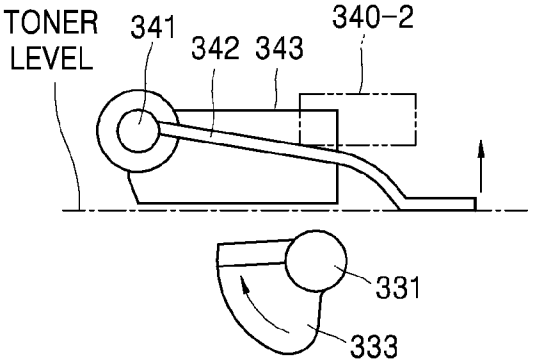

FIGS. 5A through 5C are views illustrating an operation of the eccentric cam 333. When there is no eccentric cam 333, the elevation plate 342 may be buried by the toner even when the toner level is high as illustrated in FIG. 5A. If so, the detection plate 343 is not detected by the sensing unit 340-2, and thus, the sensing unit 340-2 may generate a signal indicating a deficiency of the remaining amount of toner. According to the present embodiment, the eccentric cam 333 periodically elevates the elevation plate 342 accompanying the rotation of the first conveyance member 330-1. As the first conveyance member 330-1 rotates, the eccentric cam 333 pushes up the elevation plate 342 as illustrated in FIG. 5B. When the contact of the eccentric cam 333 and the elevation plate 342 ends, the elevation plate 342 may drop downwards again. However, when the elevation plate 342 touches the toner surface, the elevation plate 342 may not drop downwards anymore but stop at a location reflecting the toner level as illustrated in FIG. 5C. Therefore, the toner level may be accurately detected by the location of the elevation plate 342. Like this, the toner accumulation on the elevation plate 342 may be prevented by periodically elevating the elevation plate 342, and thus, the toner level may be more accurately detected.

Figure 6A:
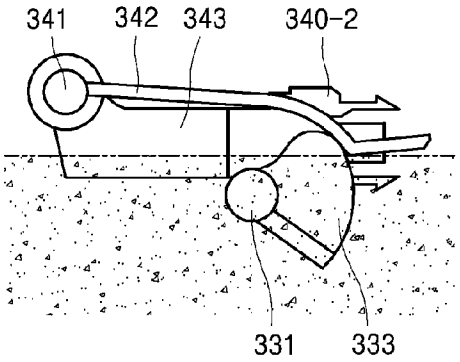
FIGS. 6A through 6D are views illustrating a state of a toner level detection unit according to a toner level.
Figure 6B:
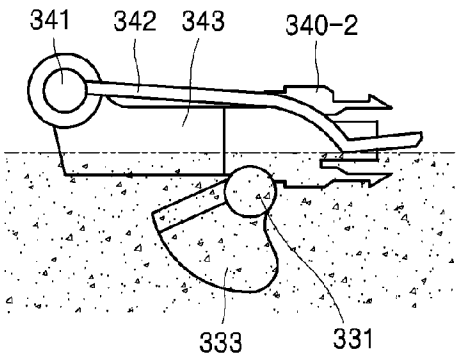

FIGS. 6A through 6D are views illustrating a state of the toner level detection unit 340 according to the toner level. FIGS. 6A and 6B show the case in which the toner level is high. In the case in which the toner level is high, even when the contact of the eccentric cam 333 and the elevation plate 342 ends after the eccentric cam 333 pushes up the elevation plate 342 as illustrated in FIG. 6A, the elevation plate 342 does not drop downwards any more after the elevation plate 342 touches the toner surface as illustrated in FIG. 6B, but remains in a state in which the elevation plate 342 touches the toner surface. Therefore, the detection plate 343 is continuously detected by the sensing unit 340-2, and, the sensing unit 340-2 may generate a signal indicating that the remaining amount of toner is sufficient.

Figure 6C:
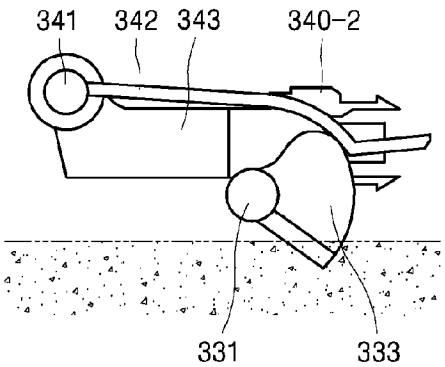
Figure 6D:
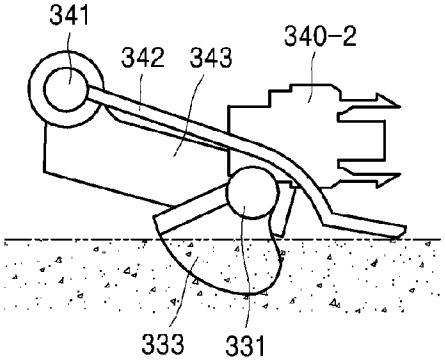

FIGS. 6C and 6D show the case in which the toner level is low. In the case in which the toner level is low, when the contact of the eccentric cam 333 and the elevation plate 342 ends after the eccentric cam 333 pushes up the elevation plate 342 as illustrated in FIG. 6C, the elevation plate 342 drops downwards to the toner surface as illustrated in FIG. 6D. Then, the detection plate 343 escapes a detection range of the sensing unit 340-2, and thus, the detection plate 343 is not detected by the sensing unit 340-2. This non-detection state continues until the first conveyance member 330-1 rotates and the eccentric cam 333 elevates again the elevation plate 342. When the detection plate 343 is not detected for a predetermined period of time, the sensing unit 340-2 may generate a signal indicating a deficiency of the remaining amount of toner.

Figure 7:
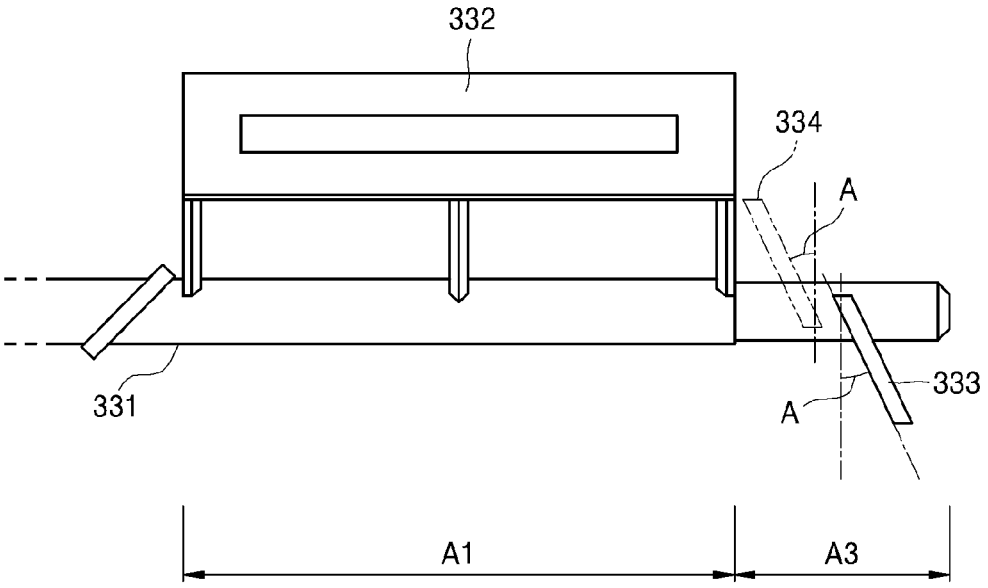
FIG. 7 is a view illustrating a transportation member transporting toner in a detection region to a conveyance region, according to an embodiment.

Referring to FIGS. 2 and 7, the first buffer unit 300*a* includes the conveyance region A1 where the conveyance wing 332 is provided and both side regions A2 and A3 of the conveyance region A1. The elevation plate 342 is arranged in an outer portion of the conveyance wing 332 in the first buffer unit 300*a*, that is, the region beyond the conveyance region A1. That is, the elevation plate 342 does not overlap the conveyance wing 332 in an axial direction of the rotation shaft 331. According to this configuration, when the conveyance wing 332 is operated, an intervention with the elevation plate 342 may be prevented. In addition, the effect on the elevation plate 342 caused by the fluctuation of the toner conveyed to the second buffer unit 300*b* by the conveyance wing 332 may be nullified or reduced.

The elevation plate 342 is arranged in one of the both regions A2 and A3 of the conveyance region A1. That is, the elevation plate 342 is arranged in a side of the conveyance wing 332 in the axial direction of the rotation shaft 331. According to the present embodiment, the elevation plate 342 is arranged in the region A3. According to this configuration, by shortening the length of the rotation shaft 341, a structural stability of the elevation member 340-1 may be increased. Furthermore, a detection accuracy of the toner level may also be increased.

The toner of the conveyance region A1 where the conveyance wing 332 is provided in the first buffer unit 300*a* is conveyed to the second buffer unit 300*b* by the conveyance wing 332. However, since a region where the elevation plate 342 is arranged in the first buffer unit 300*a* (a toner level detection region A3) is a region beyond an operation range of the conveyance wing 332, the toner of the toner detection region A3 may not be conveyed by the conveyance wing 332. Thus, in the toner level detection region A3, the toner may not flow but stagnant. In this case, even when the toner level in another region of the first buffer unit 300*a*, for example, the conveyance region A1, is low, the toner level in the toner level detection region A3 remains high so that the accuracy of detecting the remaining amount of toner may be reduced.

To resolve this problem, a transportation member to transport the toner to the conveyance region A1 may be positioned in the toner level detection region A3. The transportation member may be formed integrally with the first conveyance member 330-1. For example, as illustrated in dotted lines of FIG. 7, a transportation plate 334 tilting in angle A with respect to the rotation shaft 331 may be positioned in an end portion of the rotation shaft 331 of the first conveyance member 330-1, corresponding to the toner level detection region A3. According to this configuration, the toner stagnation in the toner level detection region A3 may be prevented, by conveying the toner in the toner level detection region A3 to the conveyance region A1. Although not shown in the drawings, it is also feasible that two or more transportation plates 334 may be positioned. The form of the transportation member is not limited thereto. The form may also include a spiral wing.

The transportation member may be formed integrally with the eccentric cam 333. For example, as illustrated in lines of FIG. 7, the eccentric cam 333 may be arranged in a spiral shape titling in angle A with respect to the rotation shaft 331. According to this configuration, when the eccentric cam 333 rotates, the toner around the eccentric cam 333 may be transported toward the conveyance region A1.

In the process that the toner flows in the first buffer unit 300*a* from the toner cartridge 200 through the toner inflow portion 310, the toner may accumulate on the elevation plate 342. Also, the toner in the first buffer unit 300*a* may accumulate on the elevation plate 342 by being dispersed by the conveyance wing 332. Like this, the elevation plate 342 may be manufactured in various forms in which the toner accumulating on the elevation plate 342 may naturally flow down from the elevation plate 342 when the elevation plate 342 is elevated.

Figure 8A:
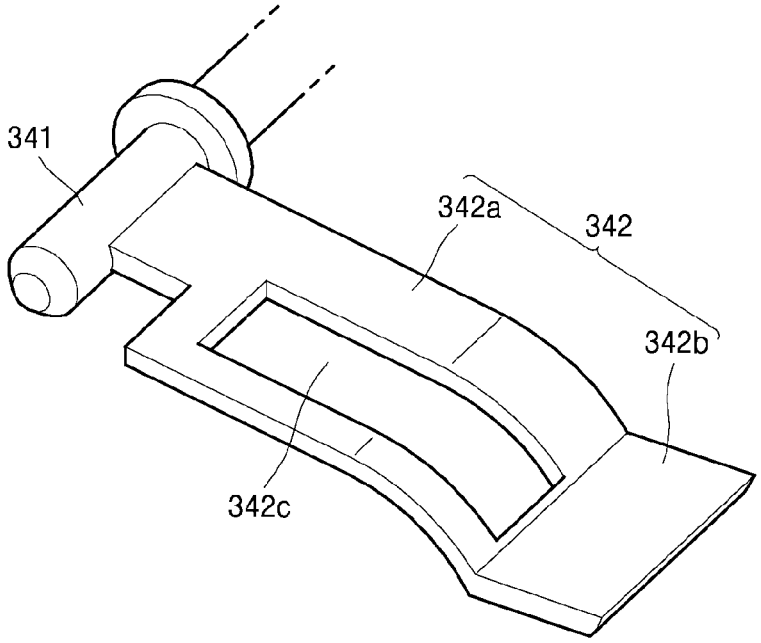
FIGS. 8A through 8F are views illustrating an elevation plate according to embodiments.
Figure 8B:
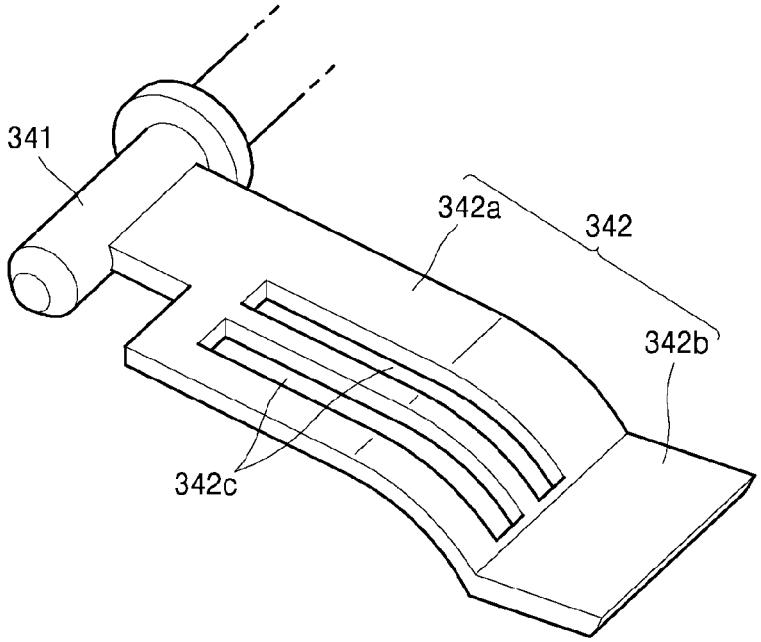

FIGS. 8A through 8F are views of the elevation plate 342 according to embodiments. Referring to FIG. 8A, the elevation plate 342 may include a first portion 342*a* extending from the support shaft 341 and a second portion 342*b* located at an end of the first portion 342*a* and laid on the toner surface. Since the first portion 342*a* is not a portion laid on the toner surface, an area of the first portion 342*a* may be reduced as much as possible so as not to let the toner accumulate thereon. In order to reduce the area of the first portion 342*a* as much as possible while maintaining the rigidity of the elevation plate 342, a penetration slot (opening) 342*c* may be formed in the first portion 342*a*. Also, two or more slots 342*c* (openings) may be formed as illustrated in FIG. 8B. According to this configuration, toner accumulation on the first portion 342*a* may be prevented in a certain degree, and, even if the toner accumulates on the first portion 342*a* in a certain degree, the toner accumulating on the first portion 342*a* may easily be removed through the slot 342*c* when the elevation plate 342 is elevated by the eccentric cam 333.

Figure 8C:
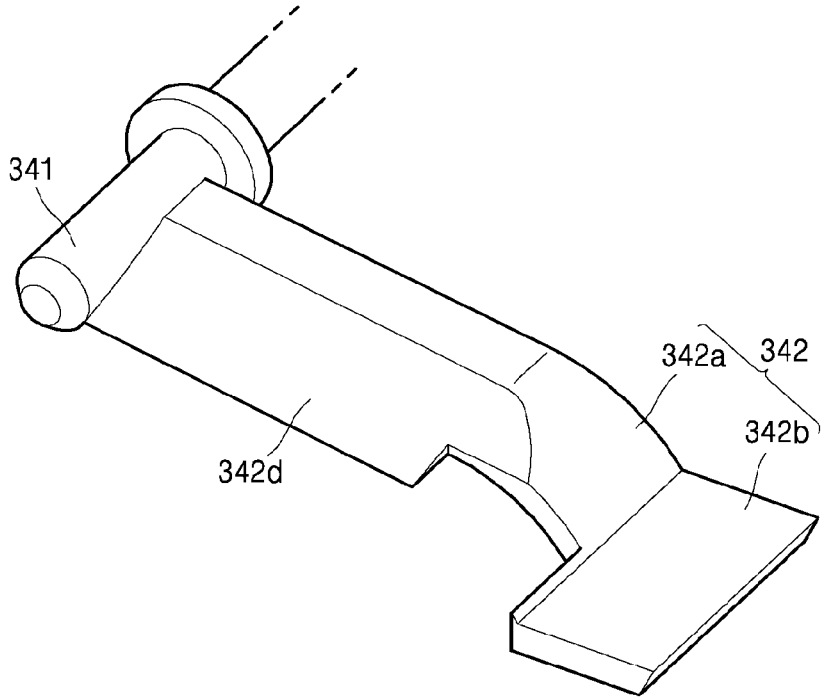
Figure 8D:
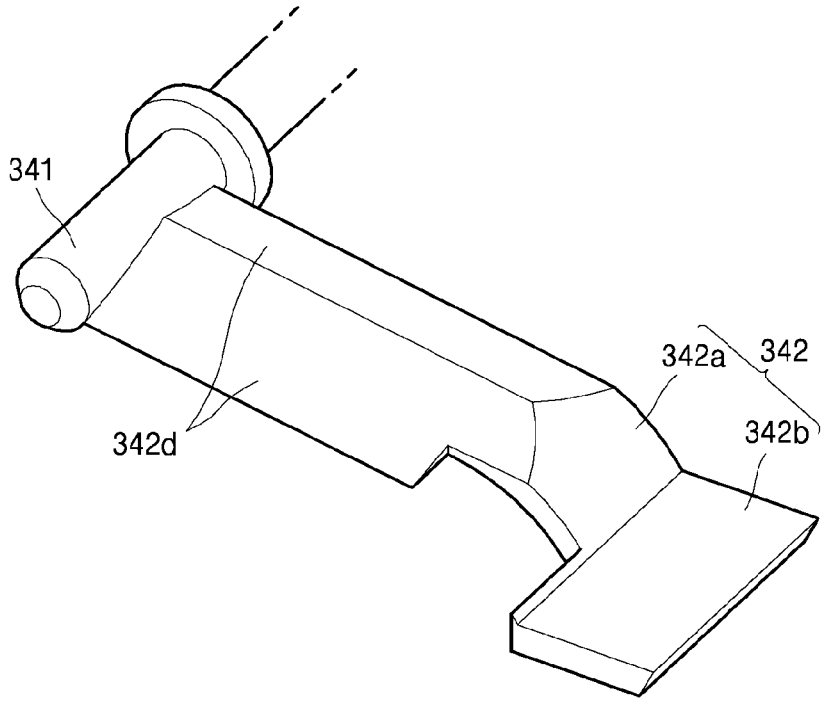

Referring to FIG. 8C, a tilting portion 342*d* titling downwards may be configured (e.g. formed) in a width direction of the first portion 342*a*, that is, a side edge in an axial direction of the rotation shaft 331 of the first conveyance member 330-1. As illustrated in FIG. 8D, the tilting portion 342*d* may also be configured (e.g. formed) in both side edges in the width direction of the first portion 342*a*. According to this configuration, the toner accumulation on the first portion 342*a* may be prevented in a certain degree, and, when the elevation plate 342 is elevated by the eccentric cam 333, the toner accumulating on the first portion 342*a* may easily flow down along the tilting portion 342*d*.

Figure 8E:
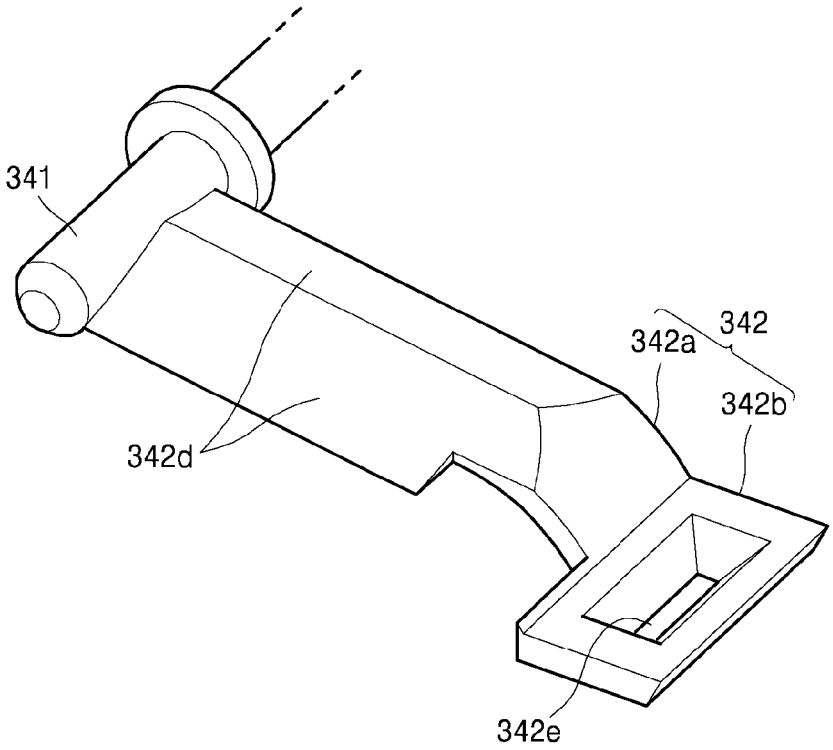
Figure 8F:
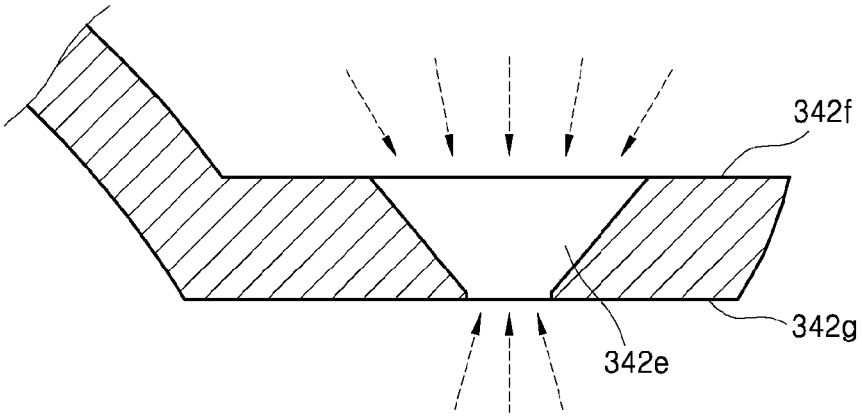

Referring to FIG. 8E, a through-hole 342*e* may be positioned in the second portion 342*b*. The through-hole 342*e* may have a form in which an area of the through-hole 342*e* is smaller towards a bottom surface 342*g* of the second portion 342*b* from an upper surface 342*f* of the second portion 342*b*, as illustrated in FIGS. 8E through 8F. According to this configuration, the toner accumulating on the upper surface 342*f* of the second portion 342*b* may easily flow down to the bottom surface 342*g* of the second portion 342*b* naturally through the through-hole 342*e*. However, the toner does not flow well in the opposite direction, that is, from the bottom surface 342*g* to the upper surface 342*f*. Therefore, the second portion 342*b* may easily be laid on the toner surface and remain at a location reflecting the toner level.

It should be understood that exemplary embodiments described above should be considered in a descriptive sense only and not for purposes of limitation. Descriptions of features or aspects within each embodiment should typically be considered as available for other similar features or aspects in other embodiments.

While embodiments have been described with reference to the figures, it will be understood by those of ordinary skill in the art that various changes in form and details may be made therein without departing from the spirit and scope of these embodiments as defined by the following claims and their equivalents.

What is claimed is:

1. An electrophotographic image forming apparatus comprising:

a developing unit including a photoreceptor;

a toner cartridge;

a toner buffer unit, which receives toner from the toner cartridge and which supplies the toner to the developing unit, the toner buffer unit including a first buffer unit connected to the toner cartridge, and the first buffer unit including a first conveyance member which includes a rotation shaft and a conveyance wing arranged in the rotation shaft to transport the toner in a radial direction; and a toner level detection unit which detects a remaining amount of toner in the first buffer unit, which includes an elevation plate arranged in the first buffer unit configured to elevate according to a toner level, and which includes a sensor unit which detects an elevation of the elevation plate, wherein the toner buffer unit is positioned between the toner cartridge and the developer unit, and wherein the elevation plate is spaced apart from the conveyance wing in an axial direction of the rotation shaft.

2. The electrophotographic image forming apparatus of claim 1, wherein:

the first buffer unit comprises a conveyance region where the conveyance wing is positioned and a detection region where the elevation plate is positioned, and a transportation member which transports the toner to the conveyance region is positioned in the detection region.

3. The electrophotographic image forming apparatus of claim 2, wherein the transportation member is formed integrally with the rotation shaft.

4. The electrophotographic image forming apparatus of claim 3, wherein the transportation member comprises a tilting transportation plate configured to tilt with respect to the rotation shaft.

5. The electrophotographic image forming apparatus of claim 2, wherein an eccentric cam contacts the elevation plate and periodically elevates the elevation plate by rotation of the rotation shaft.

6. The electrophotographic image forming apparatus of claim 5, wherein the eccentric cam is configured to tilt with respect to the rotation shaft so as to serve also as the transportation member.

7. The electrophotographic image forming apparatus of claim 1, wherein the toner level detection unit further comprises:

a support shaft which is supported by a side wall of the first buffer unit, and which is connected to the elevation plate so as to be rotated by an elevation operation of the elevation plate; and a detection plate which extends toward an outer portion of the first buffer unit from the support shaft, wherein the sensor unit detects the detection plate.

8. The electrophotographic image forming apparatus of claim 7, wherein the elevation plate comprises a first portion which extends from the support shaft and a second portion located in an end portion of the first portion and laid on a toner surface.

9. The electrophotographic image forming apparatus of claim 8, wherein at least one penetration slot is formed in the first portion.

10. The electrophotographic image forming apparatus of claim 8, wherein a tilting portion to tilt downwards is formed at an edge of the first portion in the axial direction of the rotation shaft.

11. The electrophotographic image forming apparatus of claim 8, wherein, in the second portion, a penetration unit, which penetrates through an upper surface thereof to a bottom surface thereof, is formed, and wherein an area of the penetration unit is smaller towards the bottom surface from the upper surface.

12. The electrophotographic image forming apparatus of claim 1, wherein the toner buffer unit further comprises a second buffer unit which connects the first buffer unit and the developing unit, the first conveyance member conveys the toner to the second buffer unit, and a second conveyance member which conveys the toner to the developing unit is provided in the second buffer unit.

13. An electrophotographic image forming apparatus comprising:

a developing unit including a photoreceptor;

a toner cartridge;

a toner buffer unit including a first buffer unit that is arranged between the toner cartridge and the developing unit, receives toner from the toner cartridge and supplies the toner to the developing unit, the toner buffer unit includes the first buffer unit connected to the toner cartridge, and a second buffer unit connected to the first buffer unit and the developing unit; and a toner level detection unit which detects a toner level in the first buffer unit, wherein:

a first conveyance member, which pumps up the toner and conveys the toner to the second buffer unit, is positioned in the first buffer unit;

the toner cartridge and the developing unit are arranged in a first direction perpendicular to an axial direction of the photoreceptor, and the toner cartridge is located above the developing unit;

the first buffer unit and the second buffer unit are arranged in a second direction that is the axial direction of the photoreceptor, and are located next to the developing unit in the first direction and below the toner cartridge;

the second buffer unit is located above the developing unit;

the first buffer unit further extends below the second buffer unit;

the first conveyance member comprises a rotation shaft and a conveyance wing arranged in the rotation shaft and transporting the toner in a radial direction;

the first buffer unit includes a conveyance region where the conveyance wing is positioned and a detection region that is located in a side of the conveyance region;

the toner level detection unit includes an elevation plate positioned in the detection region and elevated according to the toner level, and a sensing unit to detect the position of the elevation plate;

an eccentric cam contacts the elevation plate and periodically elevates the elevation plate in the detection region; and the eccentric cam is configured to tilt with respect to the rotation shaft of the first conveyance member to convey the toner in the detection region to the conveyance region.

14. The electrophotographic image forming apparatus of claim 13, wherein a second conveyance member, which conveys the toner in the first direction and supplies the toner to the developing unit, is positioned in the second buffer unit.

15. The electrophotographic image forming apparatus of claim 14, wherein the rotation shaft of the first conveyance member is parallel to a rotation shaft of the second conveyance member, and wherein the rotation shaft of the first conveyance member is located below the rotation shaft of the second conveyance member.

16. The electrophotographic image forming apparatus of claim 13, wherein the eccentric cam is coupled to the rotation shaft of the first conveyance member.

* * * * *